US005201290A

United States Patent [19]

Hu

[11] Patent Number: 5,201,290

[45] Date of Patent: Apr. 13, 1993

[54] COMPRESSION RELIEF ENGINE RETARDER CLIP VALVE

[75] Inventor: Haoran Hu, Windsor, Conn.

[73] Assignee: Jacobs Brake Technology Corporation, Wilmington, Del.

[21] Appl. No.: 816,662

[22] Filed: Jan. 3, 1992

[51] Int. Cl.[5] ..... F02D 13/04

[52] U.S. Cl. ..... 123/321; 123/90.12

[58] Field of Search ..... 123/321, 322, 90.12, 123/90.13

[56] References Cited

U.S. PATENT DOCUMENTS

| | | | |
|---|---|---|---|
| 3,220,392 | 11/1965 | Cummins | 123/321 |
| 3,405,699 | 10/1968 | Laas | 123/320 |
| 4,399,787 | 8/1983 | Cavanagh | 123/321 |
| 4,423,712 | 1/1984 | Mayne et al. | 123/321 |
| 4,706,625 | 11/1987 | Meistrick et al. | 123/321 |
| 4,898,128 | 2/1990 | Meneely | 123/321 |

*Primary Examiner*—Andrew M. Dolinar

*Attorney, Agent, or Firm*—Robert R. Jackson; G. Victor Treyz

[57] ABSTRACT

An improved clip valve for use in a compression release engine retarder is disclosed. The clip valve assembly incorporates an improved mechanism for arresting the downward motion of a clip valve plunger by using a retaining ring. The apparatus is more robust than previous designs and is easier and cheaper to manufacture. In accordance with another feature of the invention, the new design allows a reduction in the portion of the adjustable screw which is hollow.

14 Claims, 5 Drawing Sheets

COMPRESSION RELIEF ENGINE RETARDER CLIP VALVE

BACKGROUND OF THE INVENTION

This invention relates to compression relief engine retarders, and more particularly to slave pistons in these systems that incorporate a clipping mechanism to limit their maximum displacement.

Engine retarders of the compression relief type are well known in the art. In general, such retarders are designed to temporarily convert an internal combustion engine into an air compressor so as to develop a retarding horsepower which may be a substantial portion of the operating horsepower developed by the engine in its operating mode.

The basic design for an engine retarding system of the type here involved is disclosed in Cummins U.S. Pat. No. 3,220,392. In that design a hydraulic system (which may make use of oil from the associated engine) is employed wherein the motion of a master piston actuated by an appropriate intake, exhaust, or fuel injector push-tube or rocker arm controls the motion of a slave piston. The slave piston opens the exhaust valve of a cylinder of the internal combustion engine near the end of the compression stroke whereby the work done in compressing the air in that cylinder is not recovered during the subsequent expansion or "power" stroke but, instead, is dissipated through the exhaust and cooling systems of the engine.

In this type of retarder it is desirable to provide accurate timing of exhaust valve openings and a well-controlled opening rate and extent. To this end, it is advantageous in these systems to apply sharp hydraulic pulses to the slave pistons so that they open the exhaust valves rapidly. In order to both stop the slave pistons' motion and prevent excessive opening of the associated exhaust valves, reset or "clipping" mechanisms are required that reduce the hydraulic fluid pressure when either the hydraulic fluid pressure reaches a predetermined maximum or the slave pistons have reached the end of their desired stroke.

A typical slave piston design incorporating such a reset mechanism uses a lash-adjusting screw containing a reciprocating plunger that makes a face fit over a hole in the slave piston surface. With this design the travel of the reciprocating plunger is arrested upon contact with a press-fit pin that fits in a slot within the body of the plunger. However, this system is relatively costly to manufacture due to the complex configurations of its various parts, the need to test it to ensure that the pin will not come out, etc. The lash-adjusting screw may also pose a problem if it is hollow at the point at which it is held by a housing or other mounting because it may break if tightened excessively.

It is therefore an object of the present invention to provide an improved slave piston clipping apparatus. It is a more particular object of this invention to provide slave pistons which are more robust, easier to manufacture and display rapid clipping rates.

SUMMARY OF THE INVENTION

These and other objects of the invention are accomplished in accordance with the principles of the invention by providing an improved clip valve with a retaining ring inside the bore of the lash adjusting screw. The plunger contains bores that equalize the hydraulic fluid pressure between the slave piston cylinder and the interior of the hollow lash adjusting screw, allowing unhindered reciprocating motion of the plunger in the screw. The present invention allows a reduction in the length of the hollow portion of the lash-adjusting screw. The invention also improves upon the older design as it eliminates the need for the press-fit pin. The apparatus is more robust than previous designs and is easier and cheaper to manufacture.

BRIEF DESCRIPTION OF THE DRAWINGS

Further features of the invention, its nature and various advantages will be more apparent from the following detailed description of the invention and the accompanying drawings in which.

DETAILED DESCRIPTION OF THE PREFERRED EMBODIMENTS

Figure 1:
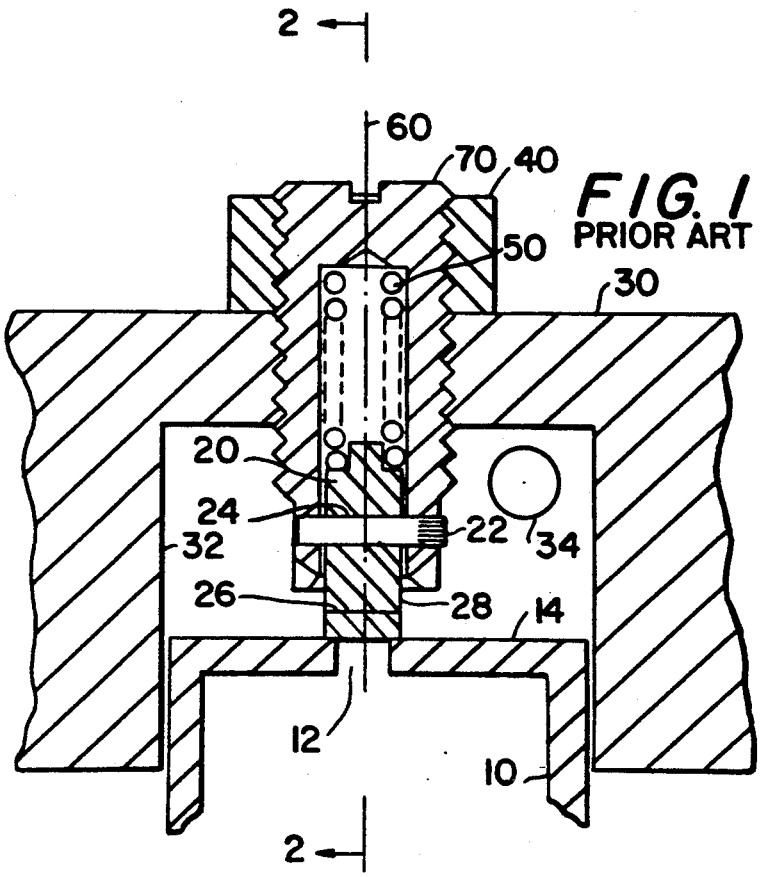
FIG. 1 PRIOR ART
FIG. 1 is a simplified cross-sectional view of a conventional slave piston system.
Figure 2:
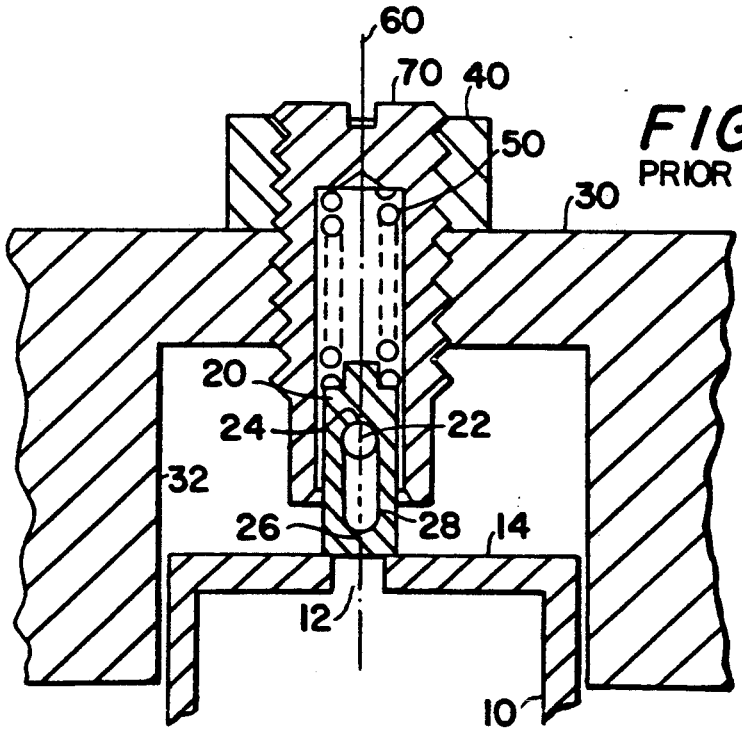
FIG. 2 PRIOR ART
FIG. 2 is a view taken along the line 2—2 in FIG. 1.
Figure 3:
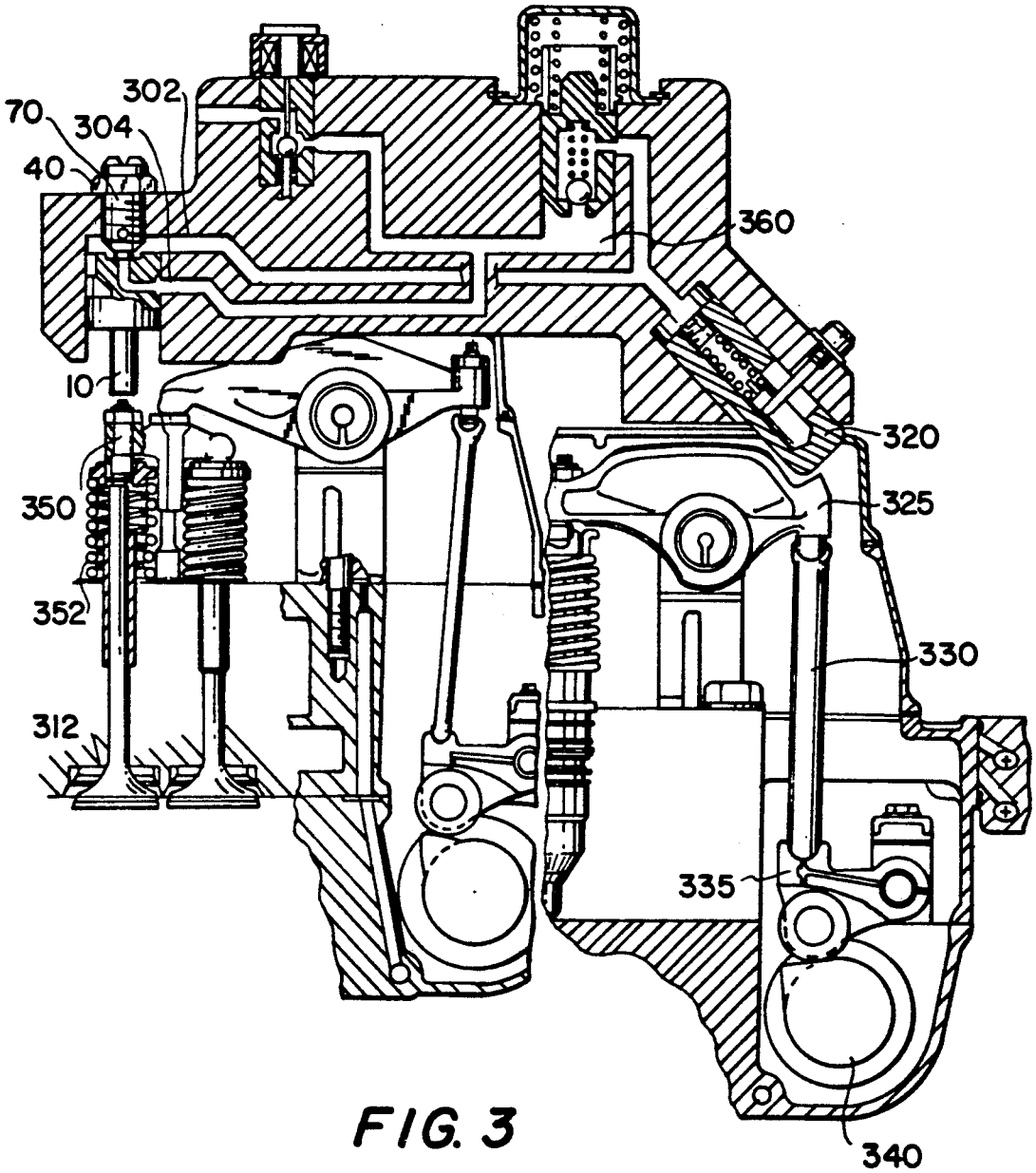
FIG. 3 is a simplified cross-sectional view of a compression relief engine retarder system employing an illustrative embodiment of the clip valve assembley of the present invention.

In the conventional slave piston apparatus shown in FIGS. 1 and 2, slave piston 10 reciprocates in slave piston cylinder 32 along longitudinal axis 60 in housing 30. The initial position of slave piston 10 is determined by the adjustment of screw 70, which is held in place against housing 30 by nut 40. In the operation of either the conventional slave piston apparatus or the apparatus of the present invention a high pressure pulse, generally in the range of 2000–4000 psi, is generated by a master piston and transmitted through a hydraulic circuit to slave piston cylinder 32 via aperture 34. As shown in FIG. 3, which shows a compression relief engine retarder system, this pulse is produced by the rotation of engine injection cam 340, which urges arm 335 to move rocker arm 325 via member 330, urging master piston 320 against the hydraulic fluid in high pressure passage 302 of the hydraulic circuit. The force of the pressurized hydraulic fluid against the top end face 14 of slave piston 10 causes slave piston 10 to move along longitudinal axis 60 in a downward direction so that slave piston 10 urges member 350 downward, holding open exhaust valve 312. Plunger 20, which reciprocates in the hollow portion of screw 70, has a slot 28 through which pin 22 is inserted. Pin 22 is press-fit into screw 70. The excursion of plunger 20 is determined by the location of pin 22 between the top 24 and the bottom 26 of slot 28. During the downward travel of slave piston 10, plunger 20 is held against aperture 12 of slave piston 10 by spring 50 so as to block the escape of hydraulic fluid until the top 24 of slot 28 comes into contact with pin 22. Spring 50 has sufficient strength to hold the flat lower end face of plunger 20 against the flat upper surface 14 of slave piston 10, forming a "face fit" between the two end faces.

When top 24 of slot 28 contacts pin 22, slave piston 10 separates from plunger 20. This allows hydraulic fluid to escape from slave piston cylinder 32 through aperture 12 in slave piston 10, thereby automatically limiting the downward travel of slave piston 10 and the amount by which the associated exhaust valve is opened. When the master piston no longer applies the high pressure pulse, slave piston 10 is driven back up to its initial position by spring 352.

Although the conventional slave piston system with the mechanism for clipping the displacement of the slave piston described above is superior to those systems without such capabilities, there is room for improvement of the design. For instance, the operation of press-fitting pin 22 into screw 70 is difficult to achieve reliably, requiring a "reverse push test" to check whether the pin is secure. Another disadvantage of the conventional design is that screw 70 is hollow adjacent the interface between housing 30 and nut 40. This can cause screw 70 to break off adjacent that interface if nut 40 is overtightened.

Figure 4:
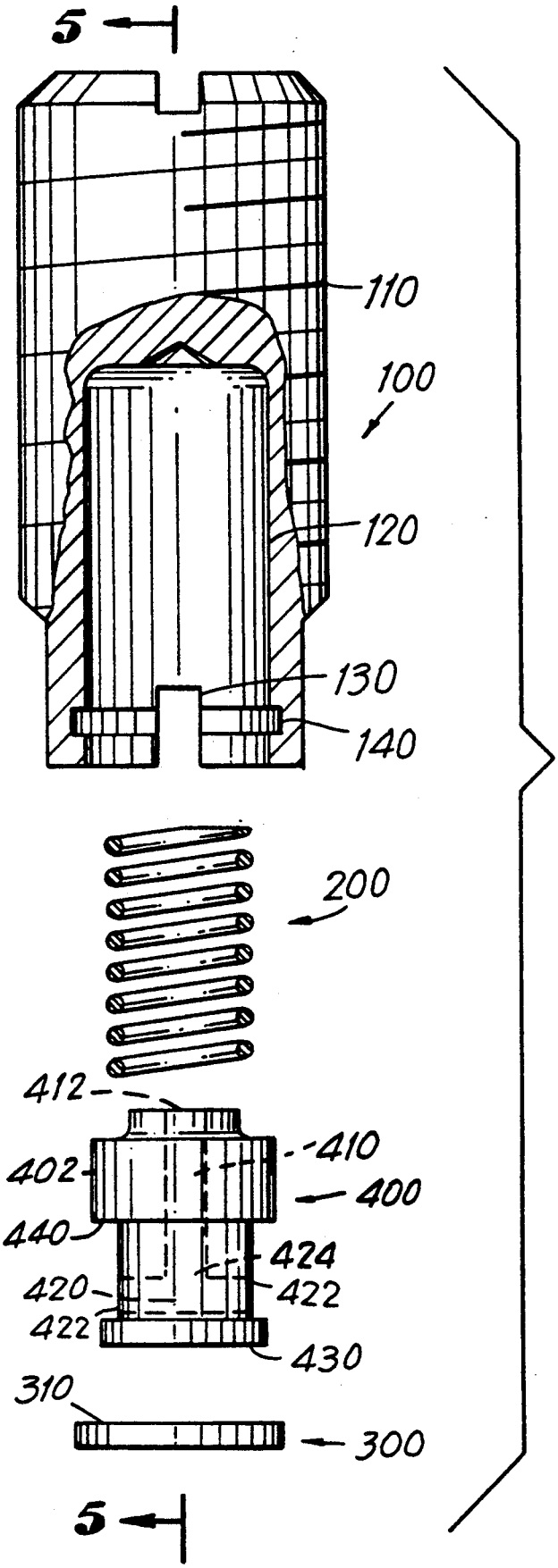
FIG. 4 is a simplified exploded view, partly in section, of the component parts of an illustrative embodiment of the clip valve assembly of the present invention.
Figure 5:
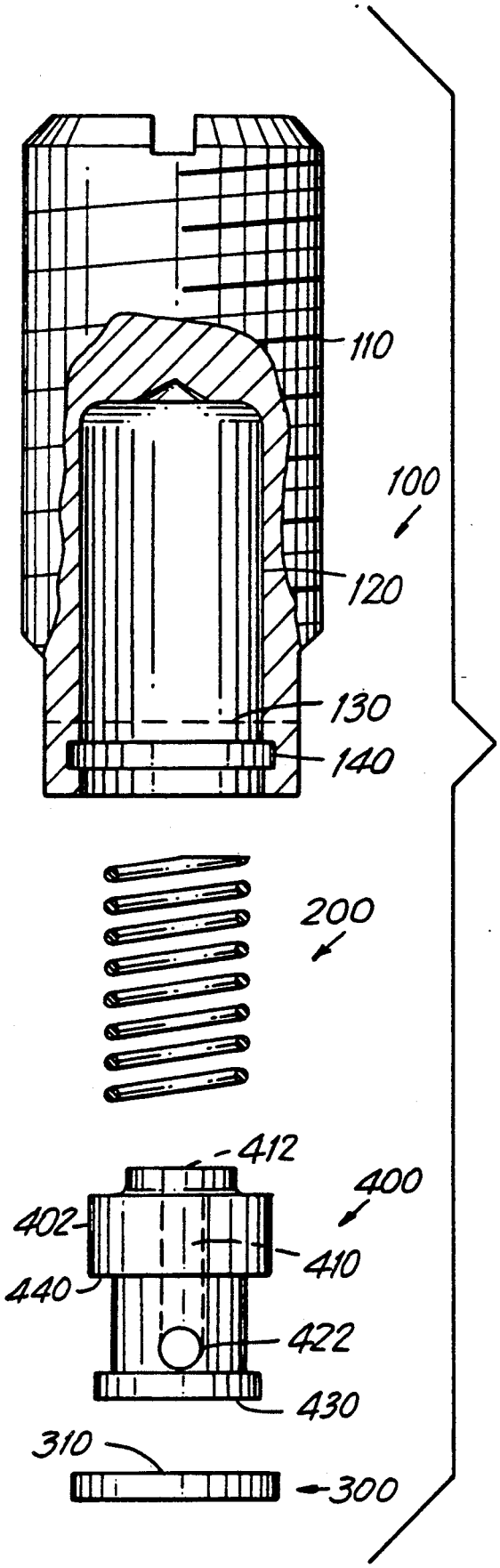
FIG. 5 is a view taken along the line 5—5 in FIG. 4.
Figure 6:
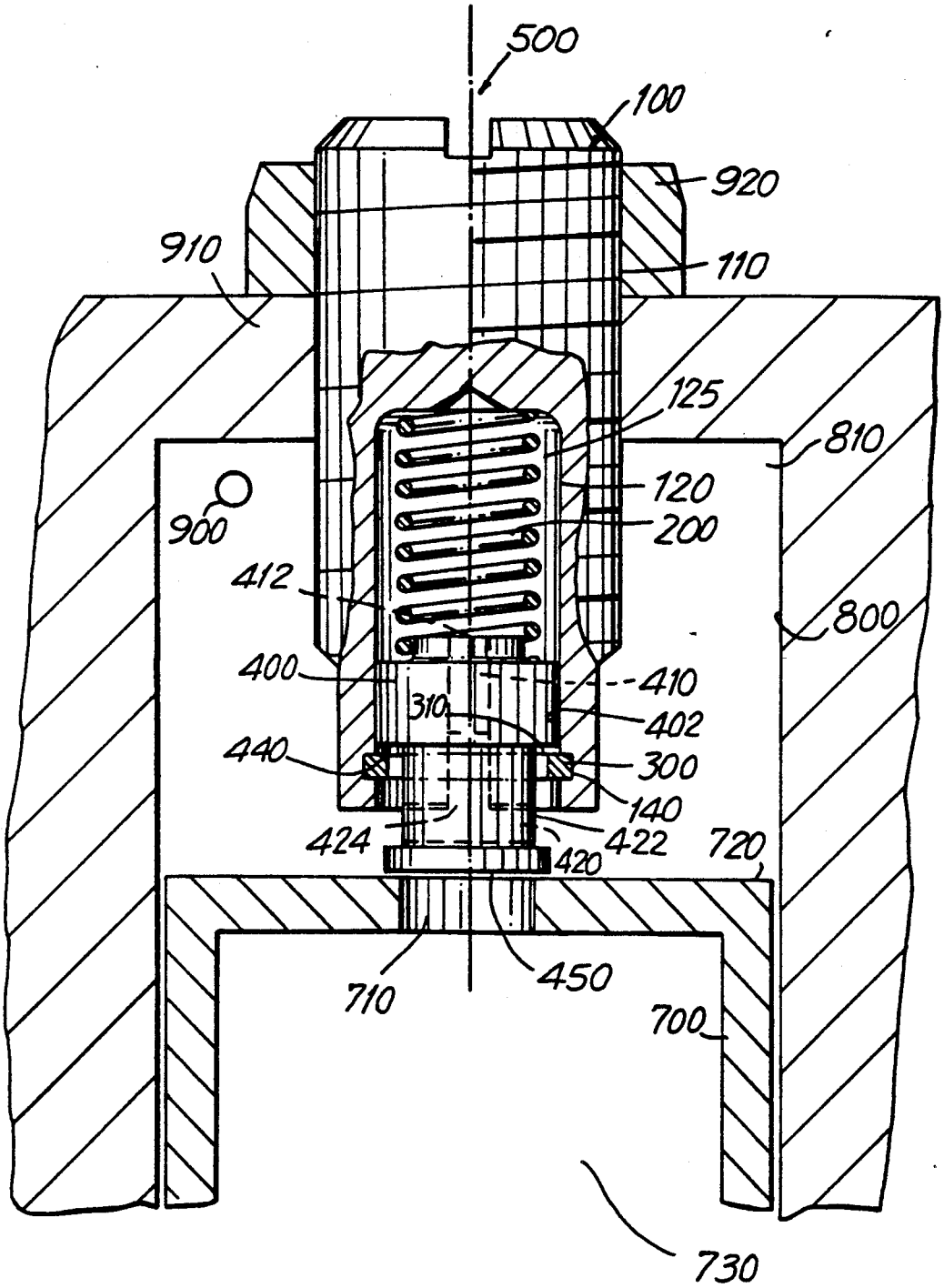
FIG. 6 is a simplified cross-sectional view of the clip valve of FIGS. 4 and 5 assembled and in use.

The components of the clip valve assembly 301 of the present invention are shown in FIGS. 4–6. They include: clip valve body screw 100, spring 200, retaining ring 300 and plunger 400. The clip valve body is threaded with threads 110, to allow adjustment of the lash in the system, and has a longitudinal bore 120, to accept plunger 400 for reciprocation within. The body also has groove 140 in the interior of bore 120, for seating retaining ring 300. At the base of lash-adjusting screw 100 is slot 130. Retaining ring 300 is initially split at one point along its circumference, and has an outer diameter larger than that of groove 140. During assembly spring 200 and plunger 400 are inserted in bore 120. Then ring 300 is annularly compressed, decreasing its diameter to less than that of bore 120, and fit within groove 140. Retaining ring 300 is then released, expanding to fit firmly in groove 140. Plunger 400 contains two bores: axial bore 410, and transverse bore 420, which is connected to bore 410 via aperture 424.

The clip valve assembly is mounted on a housing 910, as shown in FIG. 6, which includes slave piston cylinder 800. Additionally, screw 100 may be fastened to housing 910 with a lock-nut 920. Slave piston 700 reciprocates in slave piston cylinder 800 in a direction substantially parallel to longitudinal axis 500. Slave piston 700 and plunger 400 are initially in a position where slave piston return spring 352 has urged slave piston 700 toward clip valve plunger 400, overcoming weaker spring 200. In this position, upper surface 720 of slave piston 700 is in contact with lower surface 450 of plunger 400, sealing hole 710 closed.

In operation, high pressure hydraulic fluid is forced into the upper region 810 of slave piston cylinder 800 via aperture 900, creating a downward force on the upper surface 720 of slave piston 700. This force overcomes the opposite force of slave piston return spring 352, driving slave piston 700 downward so that it opens an associated exhaust valve of an associated internal combustion engine. During this motion, plunger 400 is held over hole 710 by spring 200, preventing the escape of the high pressure hydraulic fluid. Plunger 400 is free to follow the motion of slave piston 700 as the pressure within the upper region 125 of bore 120 is equalized to that of upper region 810 of slave piston cylinder 800 by the communication between these two regions via aperture 412, axial bore 410, aperture 424, transverse bore 420, and aperture 422. The pressure in regions 125 and 810 are further equalized by the passage of hydraulic fluid between exterior wall 402 of plunger 400 and bore 120, and the passage of fluid around retaining ring 300 via slot 130. As plunger 400 reaches the end of its travel, as determined by the contact of external annular shoulder surface 440 of plunger 400 with the upper surface 310 of retaining ring 300, the lower surface 450 of plunger 400 and the upper surface 720 of slave piston 700 separate. This separation allows the escape of high pressure hydraulic fluid from upper region 810 of slave piston cylinder 800 via hole 710 into low pressure region 730 of slave piston 700. When the pressure on top surface 720 is reduced, slave piston 700 is driven back up to its initial position by a spring (not shown).

In contrast to the prior art slave piston arrangement described previously, the present invention overcomes the need for pin 22 while additionally reducing the extent of the hollow portion of the screw. The apparatus is also more robust than previous designs and is easier and cheaper to manufacture.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. Clip valve apparatus for limiting the travel of a slave piston in a slave piston cylinder in a compression relief engine retarder, said cylinder being connected in a hydraulic circuit so that when hydraulic fluid is forced into said cylinder at one end of said slave piston, said slave piston moves along a longitudinal axis of said cylinder, said clip valve apparatus comprising:

a threaded body;

a first bore in said body, said first bore having side walls which are substantially parallel to said longitudinal axis;

a spring disposed in said first bore; and a plunger disposed in said first bore for reciprocation relative to said first bore substantially parallel to said longitudinal axis; wherein:

said slave piston and said plunger travel between (a) a first position in which said plunger covers a hole in said slave piston and (b) a second position in which said plunger uncovers said hole; and further comprising:

a retaining ring disposed in a groove in said first bore, whereby when said plunger is forced by said spring into contact with said retaining ring, said retaining ring arrests the motion of said plunger at substantially said second position; and a second bore in said plunger, said second bore being disposed substantially parallel to said longitudinal axis, said second bore communicating with said first bore via a first aperture, said second bore further communicating with a third bore in said plunger via a second aperture in the walls of said third bore.

2. The apparatus defined in claim 1 wherein said body further comprises a slot disposed through said body at that end of said body that is adjacent to said slave piston, said slot allowing the communication of said slave piston cylinder and an upper portion of said first bore.

3. The apparatus defined in claim 1 wherein said third bore communicates with said slave piston cylinder via third and fourth apertures in the walls of said plunger.

4. The apparatus defined in claim 1 further comprising a fifth aperture in said slave piston cylinder, said fifth aperture providing hydraulic fluid to said slave piston cylinder.

5. The apparatus defined in claim 4 wherein when said fifth aperture provides a high pressure of said hydraulic fluid to said slave piston cylinder, said slave piston and said plunger are urged toward said second position, said plunger being arrested upon contact with said retaining ring, said contact allowing said plunger to uncover said hole in said slave piston, allowing said hydraulic fluid to escape said slave piston via a low pressure region disposed in said slave piston.

6. Apparatus for limiting the travel of a slave piston in a compression relief engine retarder by allowing high pressure hydraulic fluid in a cylinder in which the slave piston reciprocates to escape from that cylinder after a predetermined amount of motion of the slave piston along a reciprocation axis of the cylinder in response to that high pressure hydraulic fluid, said slave piston having a face on which said hydraulic fluid bears in order to move said slave piston along said reciprocation axis, and an aperture through said face through which said hydraulic fluid can escape from said cylinder when said aperture is uncovered, said apparatus comprising:

a plunger disposed in said cylinder for reciprocation relative to said cylinder substantially parallel to said reciprocation axis;

means for resiliently urging said plunger to move with said slave piston when said slave piston is moved by said hydraulic fluid so that a first surface of said plunger remains in contact with said face and closes said aperture; and means mounted relative to said cylinder for contacting an external shoulder surface of said plunger which faces toward but is spaced from said face to stop said plunger from continuing to move with said slave piston after said predetermined amount of motion of said slave piston in order to separate said first surface from said face and uncover said aperture, wherein:

said plunger occupies only a portion of said bore and wherein said apparatus further comprises means for hydraulically communicating the high pressure hydraulic fluid in said cylinder to the portion of said bore which is not occupied by said plunger; and said means for hydraulically communicating comprises a passageway through the interior of said plunger.

7. The apparatus defined in claim 6 wherein said external shoulder surface is an annular surface around said plunger.

8. The apparatus defined in claim 6 further comprising:

a bore in said cylinder, said bore extending substantially parallel to said reciprocation axis, a portion of said plunger being received in said bore.

9. The apparatus defined in claim 8 wherein said external shoulder surface is on the portion of said plunger which is received in said bore.

10. The apparatus defined in claim 9 wherein said means for contacting said external shoulder surface comprises a member projecting into said bore between said first surface and said external shoulder surface.

11. The apparatus defined in claim 10 wherein said member comprises an annular retainer ring disposed in an annular channel in the surface of said bore.

12. The apparatus defined in claim 8 wherein said means for resiliently urging comprises a prestressed compression coil spring disposed in said bore for urging said plunger outwardly of said bore.

13. The apparatus defined in claim 8 wherein said bore is an axial bore in an end of a longitudinal member which is threaded through the wall of said cylinder substantially parallel to said reciprocation axis.

14. The apparatus defined in claim 10 wherein said bore is an axial bore in an end of a longitudinal member which is threaded through the wall of said cylinder substantially parallel to said reciprocation axis so that said slave piston's lash can be adjusted by threadedly adjusting said longitudinal member relative to said cylinder.

* * * * *